United States Patent [19]

Cartabbia

[11] Patent Number: 4,542,601

[45] Date of Patent: Sep. 24, 1985

[54] TROUSERS IRONING MACHINE WITH AUTOMATIC TROUSERS PICKUP

[76] Inventor: Giovanni Cartabbia, Via Fusline, 36, 25036 Palazzolo Sull'Oglio (Brescia), Italy

[21] Appl. No.: 551,077

[22] Filed: Nov. 14, 1983

[30] Foreign Application Priority Data

Aug. 22, 1983 [IT] Italy ..... 22602 A/83

[51] Int. Cl.[4] ..... D06F 71/14; D06F 71/28

[52] U.S. Cl. ..... 38/7; 38/12; 38/20; 38/28

[58] Field of Search ..... 38/7, 8, 12, 17, 20, 38/27, 28; 223/73

[56] References Cited

U.S. PATENT DOCUMENTS 2,636,293 4/1953 Gudgeon ..... 38/28 X
2,812,597 11/1957 Kramer ..... 38/8
2,994,978 8/1961 Skovira ..... 38/17 X
4,137,655 2/1979 Engelbart et al. ..... 38/27 X

*Primary Examiner*—Werner H. Schroeder
*Assistant Examiner*—A. M. Falik
*Attorney, Agent, or Firm*—Bucknam and Archer

[57] ABSTRACT

A trousers ironing machine is provided with devices for automatically picking up trousers at the end of the ironing process and successively orderly gathering them. The machine comprises essentially a pair of side-by-side flat structures each including two portions of elongate shape which are arranged sequentially lengthwise. The two elongate portions can be moved toward and away from each other and jointly rotated through 180° about an intermediate axis extending orthogonally to the plane of lay. Positioned above each flat structure is an ironing platen which is suitably set up to apply an appropriate pressure to the structure, a sliding gripper being arranged below the structure for gripping the ironed trousers and pulling them out of the structure.

7 Claims, 6 Drawing Figures

TROUSERS IRONING MACHINE WITH AUTOMATIC TROUSERS PICKUP

BACKGROUND OF THE INVENTION

The present invention relates to a trousers ironing machine incorporating devices for automatically picking up and successively gathering the ironed trousers.

As is known, in the textile clothes making industry, specially designed ironing machines are currently employed for finishing articles of clothing prior to attaching buttons and similar fastening arrangements thereto.

Also known is that of such machines, those designed for trousers ironing usually comprise an elongate plate formed by two portions laid side-by-side lengthwise.

The two "legs" of a pair of trousers are stretched over said two portions, the common upper portion of the trousers being inserted from above through an interspace separating said two portions.

Then, a movable platen is lowered from above to compress the two trousers legs and carry out the ironing process by suitable application of steam, heat, suction, and the like.

With such conventionally constructed machines, however, the thusly ironed trousers are finally removed from the machine by an operator, obviously in a manual fashion.

This operation, on the other hand, forcibly introduces some uneven random pulling actions in the various parts of the trousers to alter the surface appearance thereof as imparted by the ironing process.

Further, with such prior trousers ironing machines, a number of operators are required, which adversely affects the finished article cost.

SUMMARY OF THE INVENTION

It is a primary object of this invention to obviate such prior disadvantages. With this machine, in fact, the ironed trousers are removed in an automated fashion along the trousers longitudinal axis, which coincides with those of the trousers seams, thus avoiding any uneven random pulling actions.

A further object of the invention is to provide a trousers ironing machine which may be advantageously supplemented with ancillary equipment for orderly gathering the ironed trousers.

Another object of this invention is to provide a trousers ironing machine which can make the job of its operators simpler and easier.

These and other objects, such as will be apparent hereinafter, are achieved by a trousers ironing machine according to the invention, characterized in that it comprises a pair of side-by-side flat structures each including two portions of elongate shape and arranged sequentially lengthwise, said two elongate portions being controllably movable toward and from each other and jointly rotatable through 180° about an intermediate axis extending orthogonally to the plane of lay thereof. Above one of said flat structures there being provided an ironing platen which can be brought to bear with an appropriate pressure on said one structure. Below said one structure there being arranged a sliding gripper operative to grip the ironed trousers at the waist and pull them out of said one structure and lay them onto suitable gathering devices.

BRIEF DESCRIPTION OF THE DRAWINGS

Further features and advantages of the trousers ironing machine according to this invention will be more clearly understood from the following description of a preferred embodiment thereof, with reference to the accompanying illustrative drawings, where.

DESCRIPTION OF A PREFERRED EMBODIMENT

Figure 1:
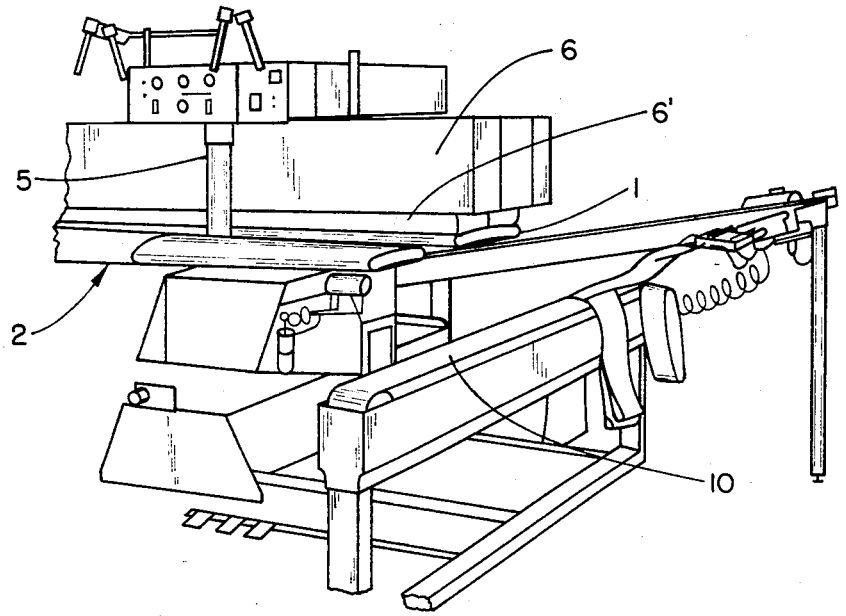
FIG. 1 is a fragmentary perspective view showing schematically this machine as supplemented with a first ironed trousers gathering device of a linear type.
Figure 6:
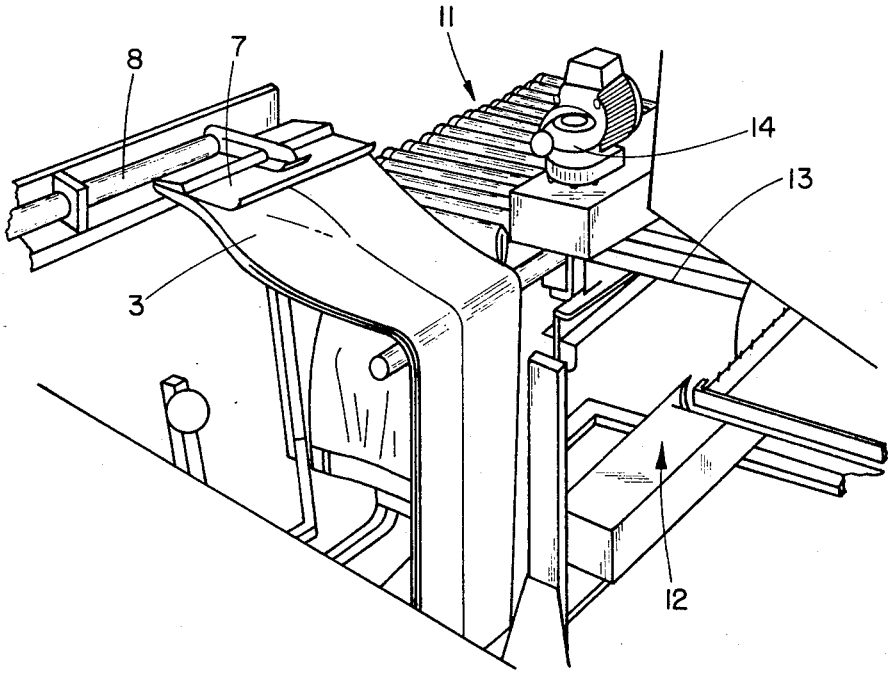
FIG. 6 is a detail view of the gripper at the end-of-travel position thereof, prior to releasing the trousers onto one arm of said carousel gathering device.

Making particular reference to the reference characters and numerals in the various drawing views, this trousers ironing machine comprises essentially two horizontally side-by-side flat structures, indicated at 1 and 2, respectively.

Each of the said two structures includes two portions of elongate shape, 1',1'' and 2',2'', which are arranged sequentially lengthwise and sized to comfortably accommodate, in a stretched position, the two legs 3' and 3'' of a pair of trousers, the common portion whereof is indicated at 3 and allowed to hang down the compartment 4 defined between the two facing sides of said elongate portions.

One of said portions, in particular, is adapted to slide with respect to the other along its longitudinal axis so as to bring about an appropriate widening of said compartment 4 during the ironed trousers picking up step.

Furthermore, the two horizontal flat structures 1 and 2 can be rotated about an intermediate vertical axis 5 through an angle of rotation of 180°.

Said axis of rotation is materialized by a double-acting cylinder, the piston rod 19 whereof is connected to a cantilever structure 6 which is suitably set up to form with its bottom face 6' an ironing platen or press overlying one of said horizontally extending flat structures.

The piston rod of the double-acting cylinder 5 is connected to the ironing structure 6, and only this structure is lowered during ironing and elevated thereafter for removing the ironed trousers, whereas the structures 1 and 2 are fixed. Thus, the structures 1 and 2 are not raised and lowered but rather, they can only rotate around the double-acting cylinder 5 and move longitudinally relative to each other.

Figure 3:
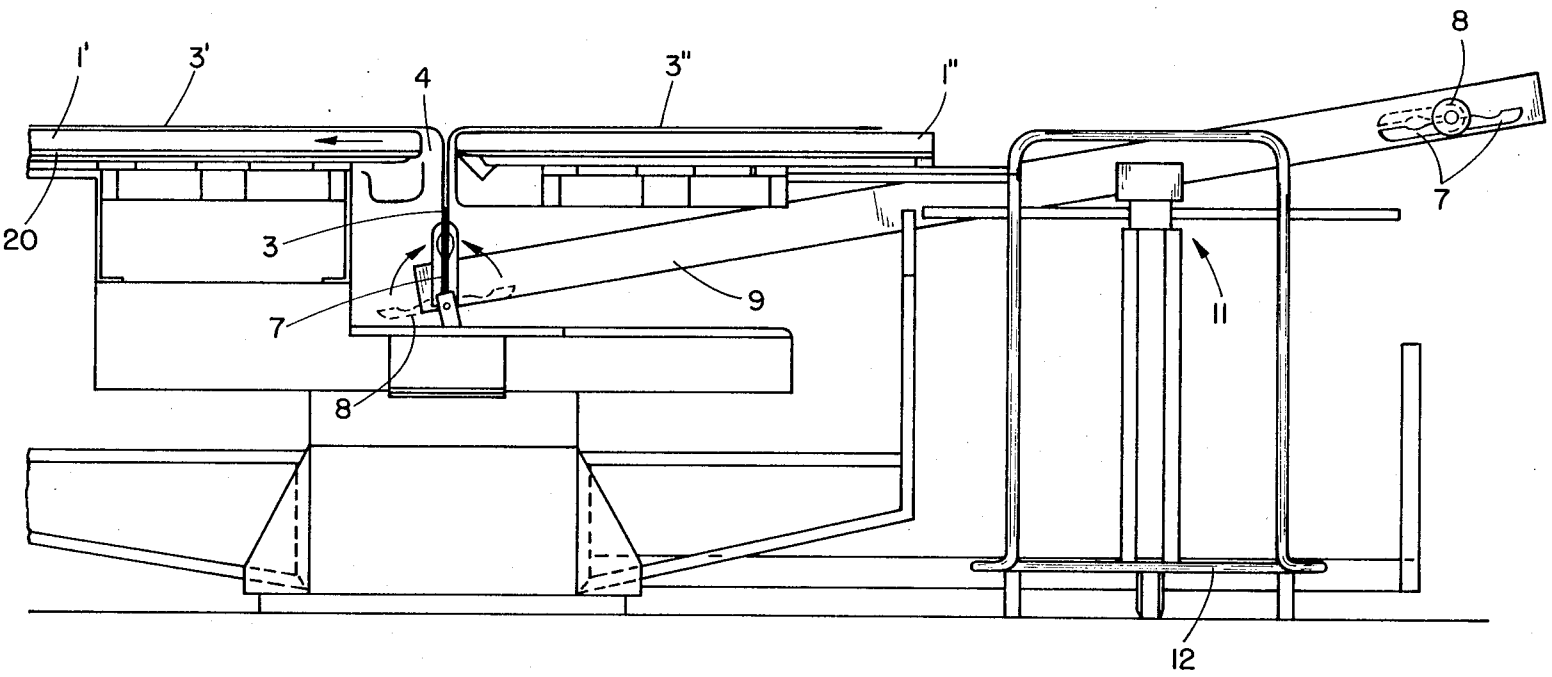
FIG. 3 shows schematically how the trousers are picked up from below by means of a specially provided gripper, following the ironing step.

In actual practice, the operator will stretch the two legs of the trousers to be ironed over the available top flat structure, and insert the common portion of the trousers through the compartment 4 with the two portions of the structure set apart. FIG. 3 illustrates the position of the pants at this stage of the operation, except that the portion of the trousers in compartment 4 would not be contacted by the gripper 7.

Thereafter, and under control by the operator, the two flat portions supporting the trousers legs are brought together (FIG. 2) and rotated through 180° about the intermediate vertical axis 5 to move to a position below the structure 6. With regard to FIGS. 1 and 2, these figures can be taken to represent the relative positions of elements 1', 1'', 2', and 2'' before the rotation. After the rotation, element 2' will occupy the space occupied by element 1' in FIG. 2, and element 2'' will occupy the space occupied by element 1'' in FIG. 2. Also, after the rotation element 1 will occupy the space formerly occupied by element 2 in FIG. 2 and element 1' will occupy the space formerly occupied by element 1 in FIG. 1. Likewise, after the rotation the flat structure 2 comprising these elements will be under the platen 6 in the way flat structure 1 is shown in FIG. 1 and the flat structure 1 will occupy the space occupied by flat structure 2 in FIG. 1. which structure is then lowered to iron said trousers legs by the platen 6'.

Figure 2:
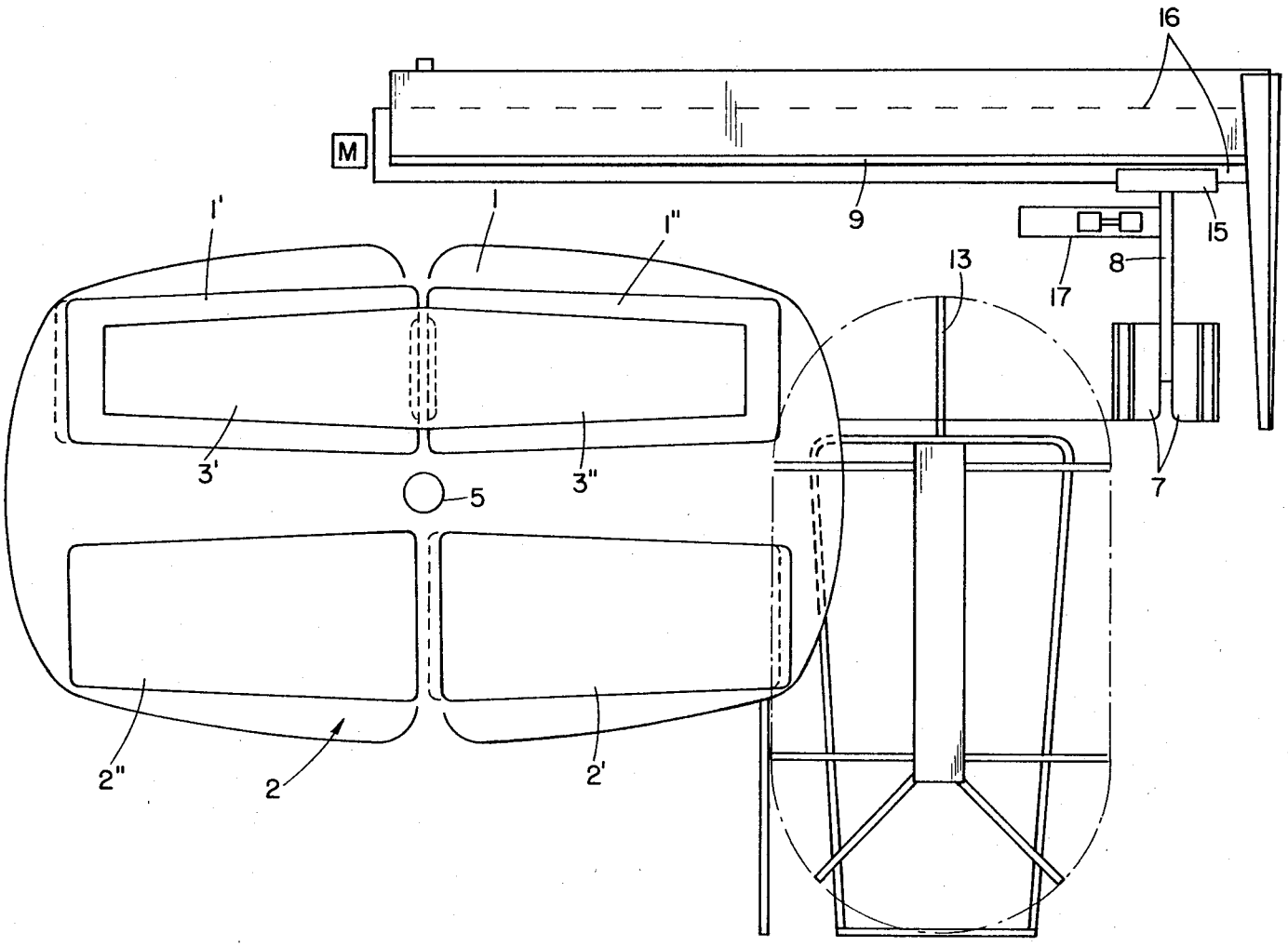
FIG. 2 is a top plan view of this machine, as supplemented with a second gathering device, of the carousel type, and without the movable top compression platen.

In FIG. 2, the small circle shown equidistant between the flat structures 1 and 2 represents the cross-section of the double acting cylinder 5, and is the rotational axis of the base supporting structures 1 and 2.

Below the flat structure which supports the trousers being ironed, there is active a gripper 7 including two wide jaws mounted on respective coaxial tubular elements 8.

The latter elements are subjected to partial rotations in opposite directions by the action of two double-acting drive cylinders 17, thereby said jaws can be driven into a closed position and open position (jaws arranged at a flat angle).

The drive cylinders/jaw-holding tubular elements assembly, as mounted on a suitable carriage 15, are arranged to slide, by means of suitable drive arrangements (e.g., of a drive chain 16), along an inclined runway 9 located outside the flat structure which supports the trousers.

In essence, after the trousers have been ironed, the structure 6 is returned to its raised position, the portions 1' and 1'' are moved apart, and the gripper 7 grips the trousers from below at the waist region thereof (FIG. 3). As shown in FIG. 3, two grippers 7 are shown, with one gripping the already ironed pants in compartment 4, and the other ready to slide down runway 9 and grip the next pair of pants which are ironed. Also, the element 1' is shown resting on guides 20 whereby element 1' may be slid towards or away from element 1'' by being pushed manually. A similar set of guides exists for element 2''.

Figure 4:
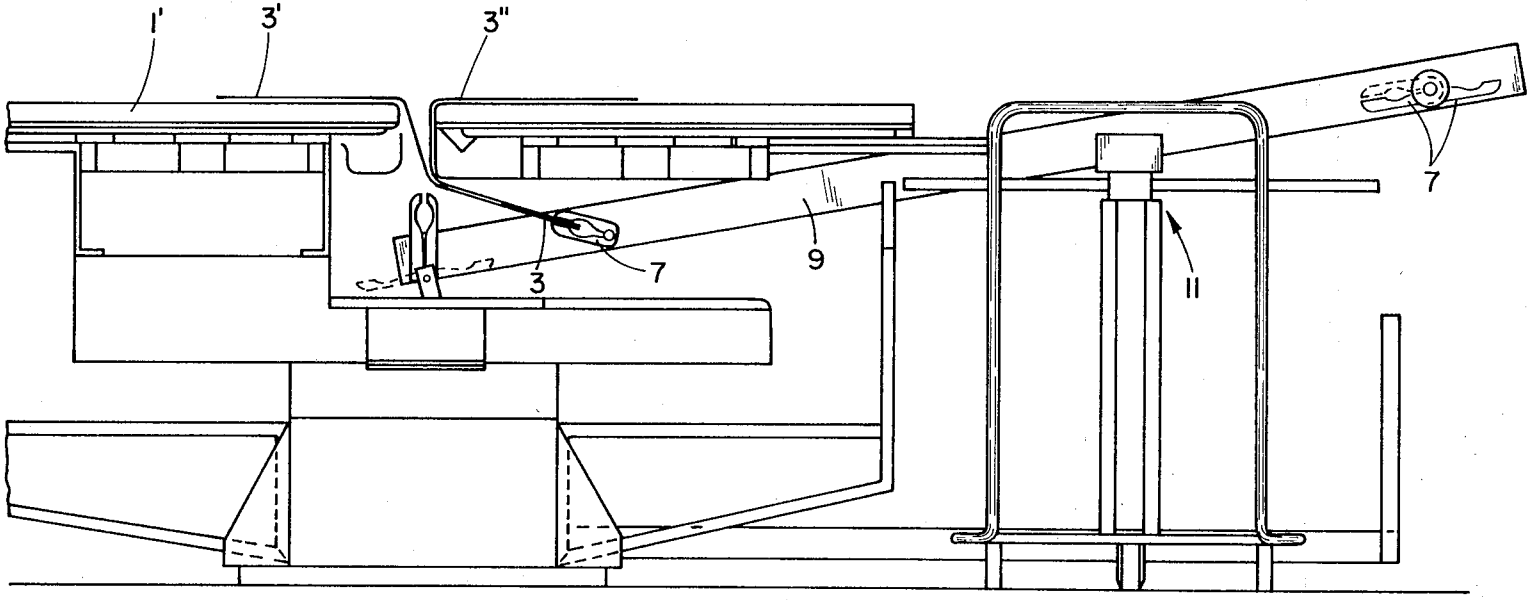
FIGS. 4 and 5 illustrate the pulling action applied by said gripper to deposit the ironed trousers onto the carousel gathering device.
Figure 5:
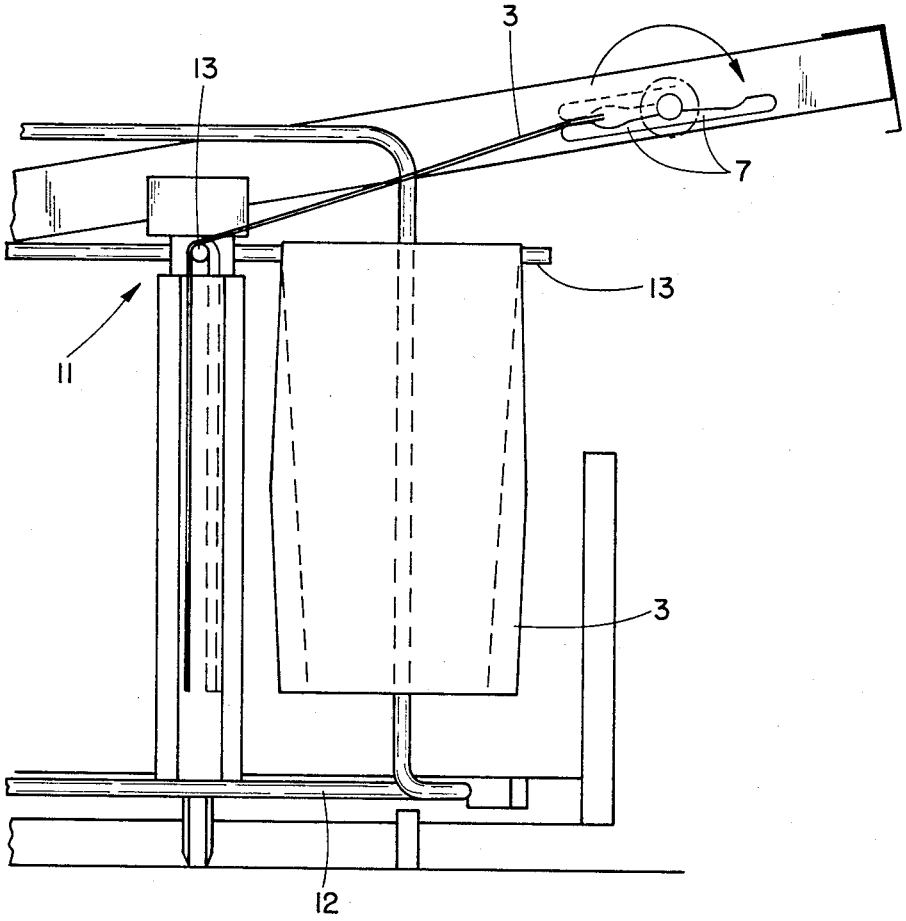

Thereafter, the gripper, in sliding along the runway 9, will slide the trousers legs off through the interspace 4 and take them along to the end of said runway. FIGS. 4 and 5 disclose the gripper 7 moving the already ironed pants along the runway 9 for deposit in the gathering device 11. More specifically, FIG. 4 discloses the gripper 7 sliding along runway 9 in an intermediate position between the position where it first grips the ironed pants (FIG. 3) and the position where it deposits them in the gathering device 11 (FIG. 5).

In particular, during its sliding movement, the gripper will undergo a rotational overall action whereby it arranges itself with the two jaws parallel to the runway.

That action may be implemented by suitably changing the pressure exerted by one of the drive cylinders on its respective tubular element.

Also provided, at a suitable location, is a suitable support onto which the ironed trousers being transported by the gripper are laid substantially at the mid-portion thereof.

Said support may include, for example and as shown in FIG. 1, a conveyor belt 10 onto which the trousers, as released by the gripper, may even be laid in stacked relationship. In practice, after a preset number of trousers pairs have been released, the conveyor belt 10 is suitably advanced to start a fresh stacking cycle, and so on. With certain trousers types, a gathering device 11 of the carousel type may be provided which is mounted on a specially provided carriage 12. Said carousel device comprises essentially a set of arms 13 which are driven along a closed loop path of a suitable extent by the action of a step motor 14. More specifically, said arms are first driven along a rectilinear path portion, and and then driven along a curvilinear end portion having a small radius of curvature such that said arms are subjected to two successive 90-degree rotations to pick up the trousers and move along a second rectilinear path portion. Said trousers supports, which are mounted on respective wheeled carriages, allow the ironed trousers to be moved to other machines for subsequent processing.

It may be appreciated from the foregoing that the trousers ironing machine of this invention features improved functionality and convenience of operation.

Of course, this machine has been described and illustrated by way of non-limiting example, and for the sole purpose of demonstrating the practicability and general features of this invention, and accordingly, the same may be varied and modified in many ways as may occur to the skilled one and fall within the scope of the innovative concepts set forth above.

I claim:

1. A trousers ironing machine, characterized in that it comprises a pair of side-by-side flat structures each including two portions of elongate shape and arranged sequentially lengthwise, said two elongate portions being controllably movable toward and from each other and jointly rotatable through 180° about an intermediate axis extending orthogonally to the plane of lay thereof, above one of said flat structures there being provided an ironing platen which can be brought to bear with an appropriate pressure on said one structure, and below said one structure there being arranged one or more sliding grippers operative to grip the ironed trousers at the waist and pull them out of said one structure and lay them onto gathering devices.

2. A trousers ironing machine according to claim 1, characterized in that said two portions of elongate shape are sized to comfortably accomodate in a stretched position the two legs of a trousers pair the common portion whereof is allowed to hang down into a compartment defined between the two facing sides of said elongate portions, one of said portions being particularly adapted to slide with respect to the other along the longitudinal axis thereof to adequately widen the said compartment gap during the ironed trousers picking up step.

3. A trousers ironing machine according to claim 1, characterized in that said intermediate axis is provided by a double-acting cylinder, the piston rod whereof is connected to a cantilever structure suitably set up to provide with the lower face thereof an ironing platen or press overlying one of said horizontal flat structures.

4. A trousers ironing machine according to claim 1, characterized in that below said one flat structure supporting the trousers there is a gripper including two wide jaws mounted on respective coaxial tubular elements which are subjected to partial rotations in opposite directions by the action of two double-acting drive cylinders to drive said jaws into a closed position and an open position.

5. A trousers ironing machine according to claim 4, characterized in that said drive cylinders/tubular elements assembly carrying said jaws are mounted on a carriage and arranged to slide, under the drive provided by drive means along an inclined runway located outside one flat structure supporting said trousers.

6. A trousers ironing machine according to claim 1, characterized in that a support is provided at a location whereon the ironed trousers, as transported by said gripper, are laid substantially at the midportion thereof, said support comprising a conveyor belt whereon the trousers released from said gripper may be laid even in stacked relationship.

7. A trousers ironing machine according to claim 1, characterized in that a support is provided at a location whereon the ironed trousers, as transported by said gripper, are laid substantially at the midportion thereof, said support comprising, a carousel type of gathering device mounted on a wheeled carriage, said carousel device including substantially a set of arms driven along a closed loop guided path of suitable extent by the action of a step motor.

* * * * *